US005474365A

United States Patent [19]

von Linsingen-Heintzmann

[11] Patent Number: 5,474,365

[45] Date of Patent: Dec. 12, 1995

[54] APPARATUS FOR MINING A SEAM, IN PARTICULAR OF COAL

[76] Inventor: Peter von Linsingen-Heintzmann, Zum Ruhrblick 4, D-44797 Bochum, Germany

[21] Appl. No.: 284,037

[22] Filed: Aug. 1, 1994

[30] Foreign Application Priority Data

Sep. 2, 1993 [DE] Germany ..... 43 29 549.5
May 6, 1994 [DE] Germany ..... 44 16 005.4

[51] Int. Cl.[6] ..... E21C 25/56; E21C 27/32

[52] U.S. Cl. ..... 299/33; 299/34.1

[58] Field of Search ..... 299/33, 34

[56] References Cited

U.S. PATENT DOCUMENTS 4,883,322 11/1989 Blumenthal et al. ..... 299/34
5,163,738 11/1992 Linsingen-Heintzmann ..... 299/10

FOREIGN PATENT DOCUMENTS 1200773 9/1965 Germany .
2806767 8/1979 Germany .
4024250 2/1992 Germany .
901512 2/1982 U.S.S.R. ..... 299/34
1040172 9/1983 U.S.S.R. ..... 299/34
1585513 8/1990 U.S.S.R. ..... 299/34

*Primary Examiner*—David J. Bagnell
*Attorney, Agent, or Firm*—Herbert Dubno; Andrew Wilford

[57] ABSTRACT

A mining apparatus that works a horizontally and longitudinally extending seam having a vertical face formed by an upper hanging wall and a lower foot wall has a longitudinal row of walking props extending along the face and each having a roof-engaging cap and a floor-engaging foot. A lower longitudinally extending long-wall mining machine juxtaposed with the lower foot wall is mounted on the floor-engaging feet and is provided with an endless lower drive chain having a forward reach extending along the lower foot wall and a rear reach extending parallel to the forward reach. It also has a conveyor trough underneath the rear reach and extending longitudinally along the face and cutters and scrapers on the chain for scraping material from the lower foot wall, depositing it in the trough, and pushing the material longitudinally along the trough. An upper long-wall mining machine juxtaposed with the upper hanging wall above the lower machine is mounted on the roof-engaging caps and is provided with an endless upper drive chain having a forward reach extending along the upper hanging wall and a rear reach. Cutters on the chain scrape material from the upper hanging wall and deposit it in the trough of the lower mining machine. The trough is positioned below the upper machine to catch material scraped from the face thereby.

11 Claims, 5 Drawing Sheets

APPARATUS FOR MINING A SEAM, IN PARTICULAR OF COAL

FIELD OF THE INVENTION

The present invention relates to an underground mining apparatus. More particularly this invention concerns such an apparatus for mining an underground coal seam.

BACKGROUND OF THE INVENTION

In my U.S. Pat. No. 5,163,728 I describe a mining apparatus for working a horizontally and longitudinally extending seam having a vertical face. This machine has a longitudinal row of walking props extending along the face and each having a roof-engaging cap, a floor-engaging foot, and a jack vertically interconnecting the respective cap and foot and expansible to press the cap up and foot down. Upper and lower long-wall mining machines corresponding generally to those described in commonly owned U.S. Pat. No. 4,883,322 of G. Blumenthal each have a predetermined height substantially less than the distance between the mine roof and floor and are each provided with a cutter for working the face and a longitudinal conveyor for carrying off material cut from the face. The upper machine is suspended from the caps well above the floor level and the lower machine is carried on the feet of the props below the caps thereof generally at floor level and spaced back toward the props from the face so that the upper machine moves on a step above the lower machine and the two machines can simultaneously work the seam at respective vertically and horizontally offset levels.

With this system, therefore, conventional-height mining machines can work together on a face that is much higher than either of them could work alone. The machines can make respective cuts that vertically overlap or these cuts can be vertically spaced. In the latter case the intervening ridge of rock can easily be broken down to be taken up by the lower machine, and in practice normally will fall down as it is undercut.

The procedure of my prior invention is different from the underhand stoping normally done in open-pit operations. In it the individual levels are worked independently. According to my earlier invention they are cut away and advanced simultaneously and synchronously. This preserves the efficiency of long-wall-mining with a single double-height cutter while avoiding the extra expense of this equipment.

The main problem with this prior-art system is that it is very complicated, with two complete cutter/conveyors. Each of these two relatively complex pieces of equipment must be driven and maneuvered, making the mining apparatus bulky, service-prone, and expensive.

OBJECTS OF THE INVENTION

It is therefore an object of the present invention to provide an improved underground seam-mining apparatus.

Another object is the provision of such an improved underground seam-mining apparatus which overcomes the above-given disadvantages, that is which is substantially simpler in construction and operation than the above-described system.

SUMMARY OF THE INVENTION

A mining apparatus works a horizontally and longitudinally extending seam having a vertical face formed by an upper hanging wall and a lower foot wall. The apparatus has according to the invention a longitudinal row of walking props extending along the face and each having a roof-engaging cap and a floor-engaging foot. A lower longitudinally extending long-wall mining machine has a predetermined height substantially less than the distance between the mine roof and floor and is juxtaposed with the lower foot wall. The lower machine is mounted on the floor-engaging feet and is provided with an endless lower drive chain having a forward reach extending along the lower foot wall and a rear reach extending parallel to the forward reach between the forward reach and the row of props. It also has a conveyor trough underneath the rear reach and extending longitudinally along the face and cutters on the chain for cutting material from the lower foot wall, depositing it in the trough, and pushing the material longitudinally along the trough. An upper long-wall mining machine also having a predetermined height substantially less than the distance between the mine roof and floor is juxtaposed with the upper hanging wall above the lower machine. The upper machine is mounted on the roof-engaging caps and is provided with an endless upper drive chain having a forward reach extending along the upper hanging wall and a rear reach extending parallel to the respective forward reach between the respective forward reach and the row of props. Cutters on the chain cut material from the upper hanging wall and deposit it in the trough of the lower mining machine. The trough is positioned below the upper machine to catch material scraped from the face thereby.

Thus with this system there is only one conveyor. All the material scraped from the face is fed to the conveyor of the lower machine and is conducted thereby to the collection location. As a result the machine is substantially less complex than the prior-art systems. It is different from the standard stoping machines that work the face to form stopes or steps in it because the machine of this invention works the upper wall so that it is just above the lower wall, not spaced forward of it as in overhand stoping or rearward of it as in underhand stoping.

According to the invention the cutters of the lower machine carry the scrapers. In addition the upper machine is provided with an endless guide having a front part and a back part and the chain is provided with sliders carrying the respective cutters and movable along the parts of the guide.

For best positioning of the upper machine the caps include roof-engaging shields provided with mounts on which the upper machine is secured. These mounts include pivots carrying the upper machine which is movable on the pivots between a raised position with the upper-machine cutters engaging the hanging face and a lowered position with the upper machine hanging down out of contact with the face. The upper machine further includes respective actuators engaged between the props and the upper machine for moving the upper machine between its positions.

The forward reach of the lower chain is generally directly underneath the forward reach of the upper chain. This ensures that the material scraped free by the upper machine will be caught by the lower machine and conducted away.

More particularly according to the invention each prop is provided with mounts defining a respective longitudinal pivot axis, a mounting bracket extending longitudinally generally a full longitudinal length of the prop and pivoted on the mounts about the pivot axis. The upper machine is mounted on the bracket and an actuator is pivoted on the respective cap. A lever system is connected between the actuator and the upper machine. The prop feet are spaced further back from the face than the respective prop caps and the trough is positioned generally under the upper machine. Furthermore each cap is provided with a roof-engaging shield movable horizontally transversely of the front and carrying the respective mounts and actuator. The shield has a part extending forwardly over the upper mining machine. Each prop has an actuator for shifting the respective shield with the upper machine horizontally transversely toward and away from the face. This shield is also movable vertically. The upper machine can be set at an angle where necessary to ensure that the material it scrapes free from the face is caught by the lower machine's conveyor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
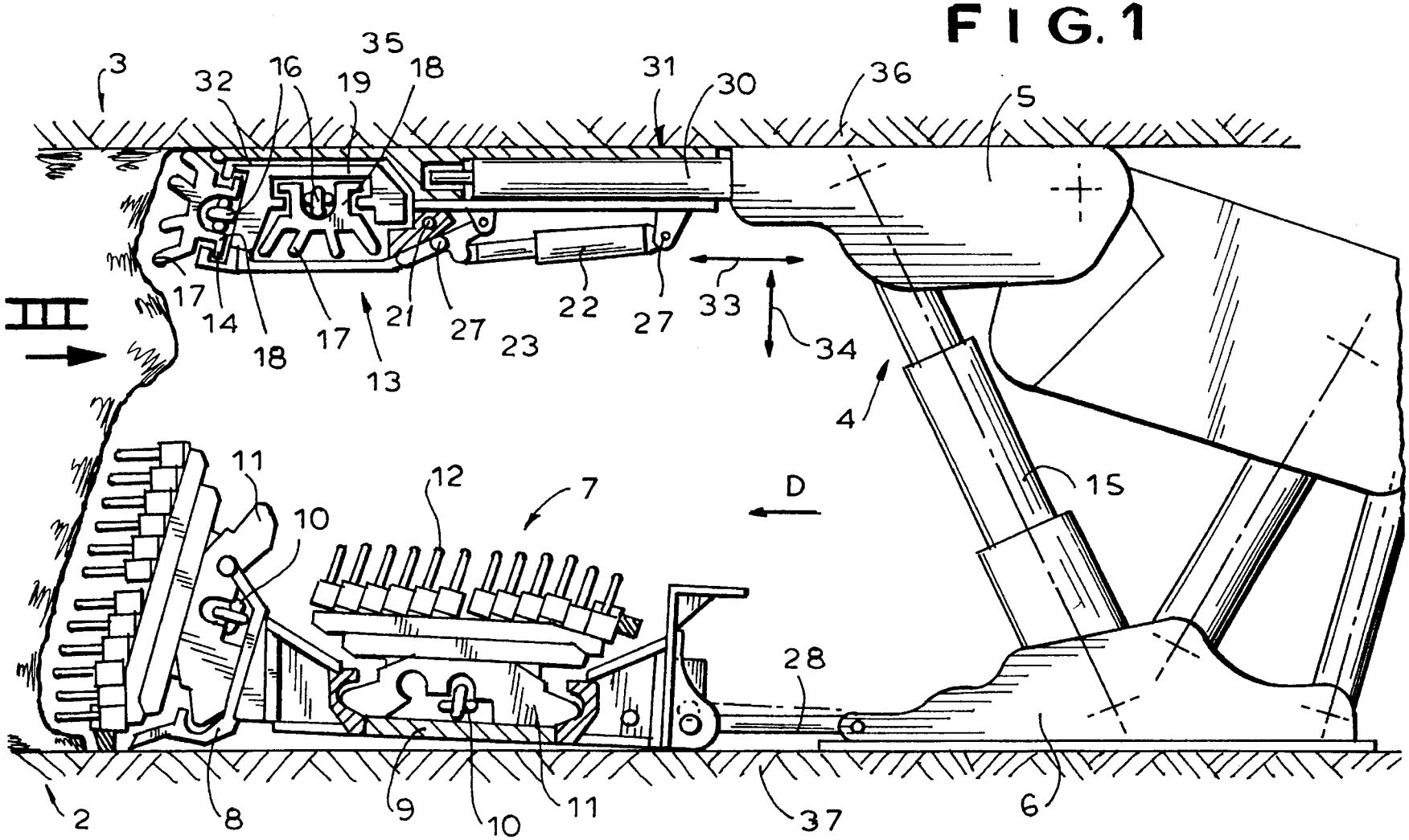
FIG. 1 is a small scale and partly diagrammatic view of the apparatus of this invention.
Figure 2:
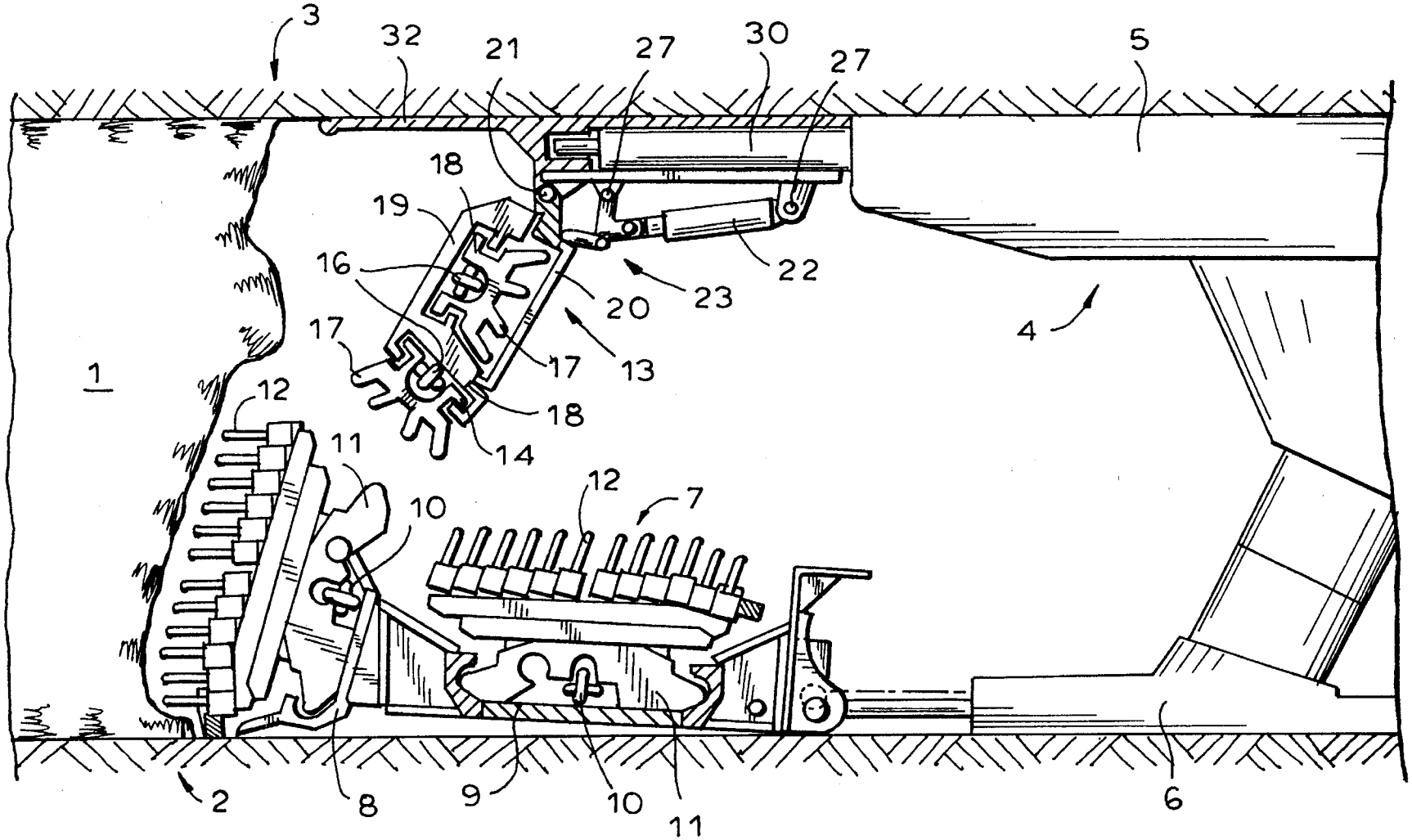
FIG. 2 is a view like FIG. 1 of the apparatus in a different operational position.
Figure 3:
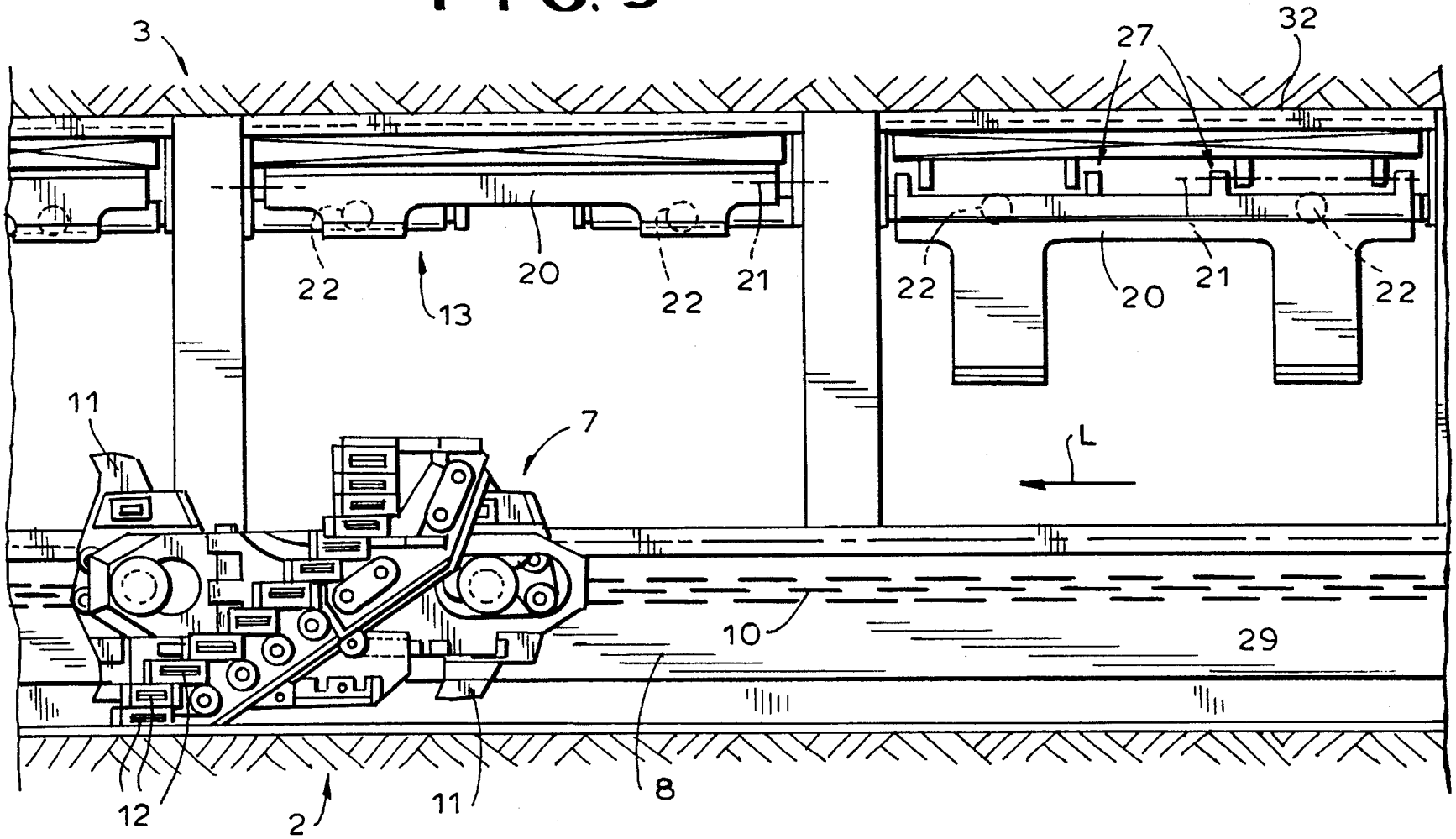
FIG. 3 is a view taken in the direction of arrow III of FIG. 1.

As seen in FIGS. 1 through 3 a mine basically has a face 1 forming a lower foot wall 2 and an upper hanging wall 3 and a roof 36 and floor 37. A mining machine has a row of props 4 spaced in a longitudinal direction L (FIG. 3) along the face 1 and each basically comprised of a roof-engaging cap 5 and a floor-engaging foot 6 that are pushed apart by a massive hydraulic cylinder 15.

A lower mining machine 7 secured by links 28 to the feet 6 and juxtaposed only with the foot wall 2 has a guide 8, 9 formed by a longitudinally extending C-section channel 8 open toward the face 1 and an upwardly open conveyor trough 9 extending longitudinally and horizontally between the channel 8 and the feet 6. An endless chain 10 carries scrapers 11 that move along the guide 8, 9 and cutters 12. When moved along the channel 8 by a drive illustrated schematically at 29 (FIG. 3) the scrapers 11 serve mainly to orient the cutters 12 so that they engage and remove material from the lower wall 2 so that this material falls into the trough 9. When moving along the trough 9 the scrapers 11 push the material cut from the face 1 to an end of the trough where it is taken by standard unillustrated machinery, while the cutters 12 are upwardly directed and perform no function.

An upper mining machine 13 mounted on the caps 5 and juxtaposed only with the hanging wall 3 has a guide 14, 19 formed by a longitudinally extending C-section channel 14 open toward the face 1 and a downwardly directed C-section guide 19 extending longitudinally and horizontally between the channel 14 and the caps 5. An endless chain 16 carries cutters 17 and sliders 18 that move along the guide 14, 19. When moved along the channel 14 by a drive illustrated schematically at 35 the cutters 17 engage and remove material from the upper wall 3 so that this material falls into the trough 9, which is positioned to receive this falling material. When moving along the return stretch 19 the sliders merely serve to carry the cutters 17 as they move longitudinally back to the end of the guide 14, 19 where they reverse and move back down, again scraping material from the face 1, as in overhand stoping but without actually making stopes.

The upper machine 13 is mounted at each of the props 5 on a support bracket 20 pivotal about an axis 21 extending longitudinally so that machine 13 can be pivoted down as shown in FIG. 2. To this end a double-acting cylinder 22 has one end pivoted on an eye 27 of the respective prop 5 and an opposite end connected via a lever system 23 to the bracket 20 to effect this pivoting. Furthermore the brackets 20 and cylinders 22 are mounted via the eyes 27 on a roof-engaging plate 31 extended over the guides 14, 19 as a roof-engaging shield 32 into which the machine fits 13 when in the up or raised position. A cylinder 30 of the respective cap allows the entire upper machine 13 with the shield 32 to be shifted in a direction 33 transversely relative to the face 1. Of course the cylinder 22 can also ensure accurate vertical positioning as shown by arrow 34.

Figure 4:
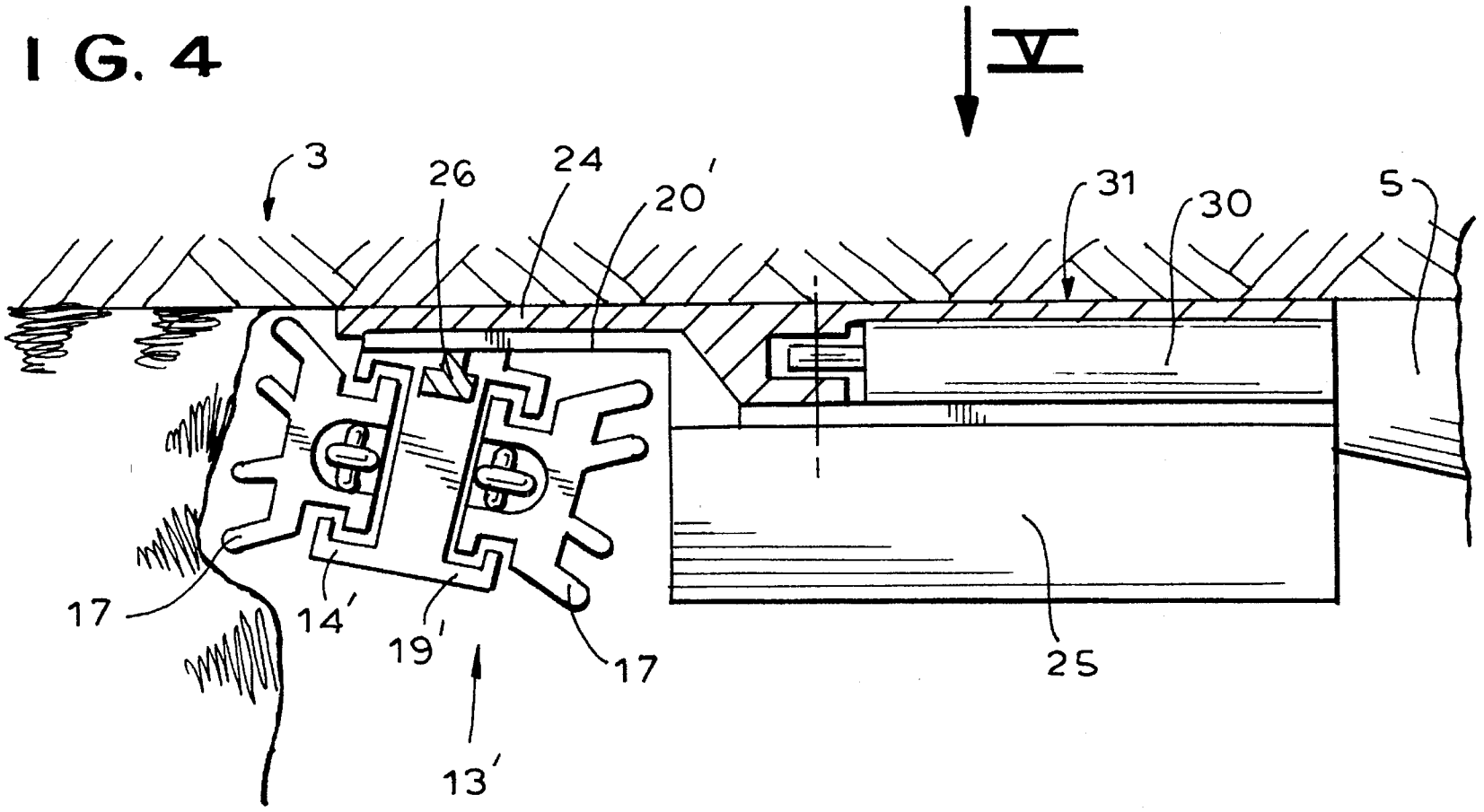
FIG. 4 is a view corresponding to a detail of FIG. 1 but showing an alternative arrangement.
Figure 5:
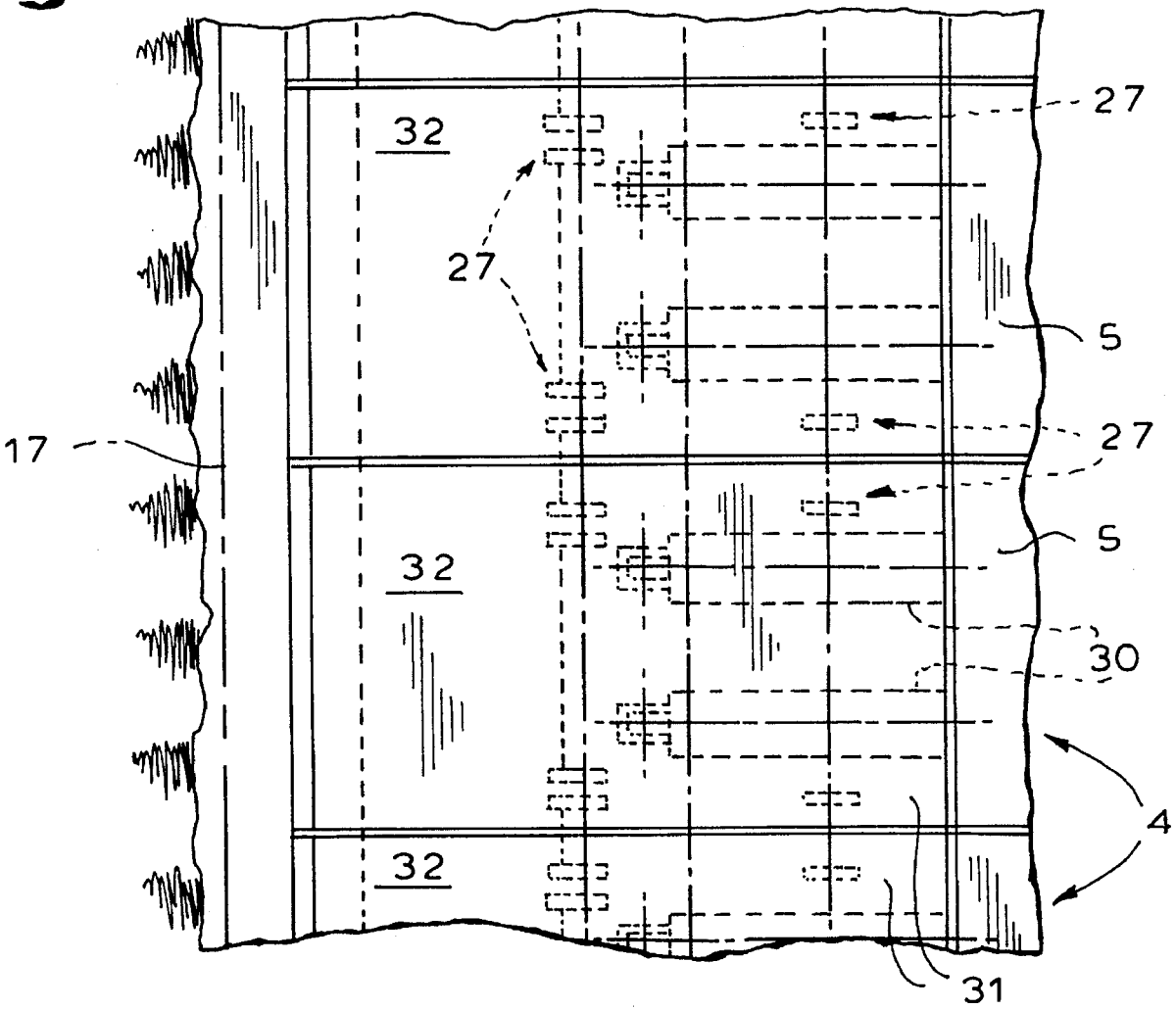
FIG. 5 is a view taken in the direction of arrow V of FIG. 4.

FIG. 4 shows a variant on this system where front and back guides 14' and 19' are both C-section channels but oppositely directed and are suspended from a T-section mounts 26 carried on a support bracket 20' fitted under a shield plate 24 like the plate 32 and operable by a lemniscate drive 25. As in FIGS. 1 through 3, even if the machine 13 is in the down or lowered position (FIG. 2), the shield 24 will hold up the roof 36. The mounts 26 permit the system to fit a nonstraight face 1.

Thus with this system the face 1 is simultaneously worked by two machines 7 and 13 that deliver the scraped-off material back to a single conveyor trough 9. While the amount of material that the system can remove is roughly double what a single-machine system can remove, the machine is not twice as complex, having only a single conveyor.

I claim:

1. A mining apparatus for working a horizontally and longitudinally extending seam having a vertical face formed by an upper hanging wall and a lower foot wall, the apparatus comprising:

a longitudinal row of walking props extending along the face and each having a roof-engaging cap, and a floor-engaging foot;

a lower longitudinally extending long-wall mining machine having a predetermined height substantially less than the distance between the mine roof and floor and juxtaposed with the lower foot wall, the lower machine being mounted on the floor-engaging feet and being provided with an endless lower drive chain having a forward reach extending along the lower foot wall and a rear reach extending parallel to the forward reach between the forward reach and the row of props, a conveyor trough underneath the rear reach and extending longitudinally along the face, and cutters and scrapers on the chain for scraping material from the lower foot wall, depositing it in the trough, and pushing the material longitudinally along the trough; and an upper long-wall mining machine having a predetermined height substantially less than the distance between the mine roof and floor and juxtaposed with the upper hanging wall above the lower machine, the upper machine being mounted on the roof-engaging caps and being provided with an endless upper drive chain having a forward reach extending along the upper hanging wall and a rear reach extending parallel to the respective forward reach between the respective forward reach and the row of props, and cutters on the chain for scraping material from the upper hanging wall and depositing it in the trough of the lower mining machine, the trough being positioned below the upper machine to catch material scraped from the face thereby.

2. The mining apparatus defined in claim 1 wherein the cutters of the lower machine carry the scrapers.

3. The mining apparatus defined in claim 1 wherein the upper machine is provided with an endless guide having a front part and a back part and the chain is provided with sliders carrying the respective cutters and movable along the parts of the guide.

4. The mining apparatus defined in claim 1 wherein the caps include roof-engaging shields provided with mounts on which the upper machine is secured.

5. The mining apparatus defined in claim 4 wherein the mounts include pivots carrying the upper machine which is movable on the pivots between a raised position with the upper-machine cutters engaging the hanging face and a lowered position with the upper machine hanging down out of contact with the face, the upper machine further including means including respective actuators engaged between the props and the upper machine for moving the upper machine between its positions.

6. The mining apparatus defined in claim 1 wherein the forward reach of the lower chain is generally directly underneath the forward reach of the upper chain.

7. The mining apparatus defined in claim 1 wherein each prop is provided with mounts defining a respective longitudinal pivot axis, a mounting bracket extending longitudinally generally a full longitudinal length of the prop and pivoted on the mounts about the pivot axis, the upper machine being mounted on the bracket, an actuator pivoted on the respective cap, and a lever system connected between the actuator and the upper machine, the prop feet being spaced further back from the face than the respective prop caps and the trough being positioned generally under the upper machine.

8. The mining apparatus defined in claim 7 wherein each cap is provided with a roof-engaging shield movable horizontally transversely of the front and carrying the respective mounts and actuator.

9. The mining apparatus defined in claim 8 wherein the shield has a part extending forwardly over the upper mining machine.

10. The mining apparatus defined in claim 8 wherein the shield is movable vertically.

11. The mining apparatus defined in claim 7, further comprising on each prop means including an actuator for shifting the respective shield with the upper machine horizontally transversely toward and away from the face.

* * * * *